US006161754A

United States Patent [19]

Arnesson et al.

[11] Patent Number: 6,161,754

[45] Date of Patent: Dec. 19, 2000

[54] THREE DIMENSIONAL PACKAGE WITH A FOLDING RECLOSABLE LID

[75] Inventors: Ingemar Arnesson; Joachim Nilsson, both of Veddige, Sweden

[73] Assignee: Wasabrod AB, Filipstad, Sweden

[21] Appl. No.: 09/393,797

[22] Filed: Sep. 10, 1999

[30] Foreign Application Priority Data

Mar. 10, 1999 [SE] Sweden ..... 99-0442

[51] Int. Cl.[7] ..... B65D 5/66

[52] U.S. Cl. ..... 229/110; 229/131; 229/149; 229/207

[58] Field of Search ..... 229/110, 131, 229/149, 207, 232, 906

[56] References Cited

U.S. PATENT DOCUMENTS

| | | | |
|---|---|---|---|
| 1,578,698 | 3/1926 | Zareko | 229/149 |
| 2,707,586 | 5/1955 | Buttery | 229/149 |
| 2,801,785 | 8/1957 | Manizza | 229/131 |
| 4,687,104 | 8/1987 | Ielmini | 229/232 |
| 4,836,438 | 6/1989 | Rigby | 229/232 |
| 5,078,273 | 1/1992 | Kuchenbecker | 229/207 |
| 5,419,486 | 5/1995 | Bennett et al. | 229/906 |
| 5,725,146 | 3/1998 | Luberto | 229/131 |

FOREIGN PATENT DOCUMENTS

| | | | |
|---|---|---|---|
| 1542461 | 3/1979 | United Kingdom | 229/131 |

*Primary Examiner*—Gary E. Elkins
*Attorney, Agent, or Firm*—Greer, Burns & Crain, Ltd

[57] ABSTRACT

The present invention provides a three dimensional package which includes a front wall, a back wall, a plurality of side walls, and a bottom wall. The bottom wall and the plurality of side walls join the front wall to the back wall in a spaced, generally parallel relationship. A lid is provided having a front wall lid portion, a tapered portion configured for covering the notched opening, and a tab configured for being gripped by a user. The lid is hinged to the front wall along a marking or hinge line. When the package is in a closed position, the tab engages in a slit in the notched wall.

16 Claims, 2 Drawing Sheets

THREE DIMENSIONAL PACKAGE WITH A FOLDING RECLOSABLE LID

FIELD OF THE INVENTION

This invention relates to a three dimensional package, and particularly to a three dimensional package with an opening which can easily be closed.

BACKGROUND OF THE INVENTION

The construction of the package permits several uses. The package can be used to transport objects. The package may also be used to store, display or dispense objects contained within it.

BRIEF SUMMARY OF THE INVENTION

The present folding, reclosable package is three dimensional with a folding reclosable lid. Included in the package are generally parallel front and back walls, at least two side walls, a notched wall having a slit and a notched opening, a bottom wall, and a lid. On the lid is a front wall portion, a tab which can be gripped by a user when opening the lid, and a tapered portion that is complementary to the notched wall. The lid is foldable or hinged along a marking line on the front wall. In a closed position, the tab of the lid engages in a slit in the notched wall.

More specifically, the present invention provides a three dimensional package which includes a front wall, a back wall, a plurality of side walls, and a bottom wall. The bottom wall and the plurality of side walls join the front wall to the back wall in a spaced, generally parallel relationship. A lid is provided having a front wall lid portion, a tapered portion configured for covering said notched opening, and a tab configured for being gripped by a user. The lid is hinged to the front wall along a marking or hinge line. When the package is in a closed position, the tab engages in a slit in the notched wall.

Paper, cardboard, plastic or other rigid materials can be used when constructing the package. The package can easily and efficiently be made out of one piece.

The present package can be manufactured to conform to the shape and dimensions of the one more objects to be stored within it. For example, a package having six edges, and therefore four side walls, could be manufactured for round objects such as bread slices. The size of the objects can influence the placing of the marking line so that a sufficiently large opening can be obtained.

One embodiment shows the marking line on the front wall extending across the full width of the front wall at the front wall's widest part. The length of the lid portion between the narrowing portion and the hinge line is at least half as long as the length of the front wall. In order to make the package stiffer and to reduce air flow into the package, the borders and edges can be glued or perforated.

DETAILED DESCRIPTION OF THE INVENTION

Figure 1:
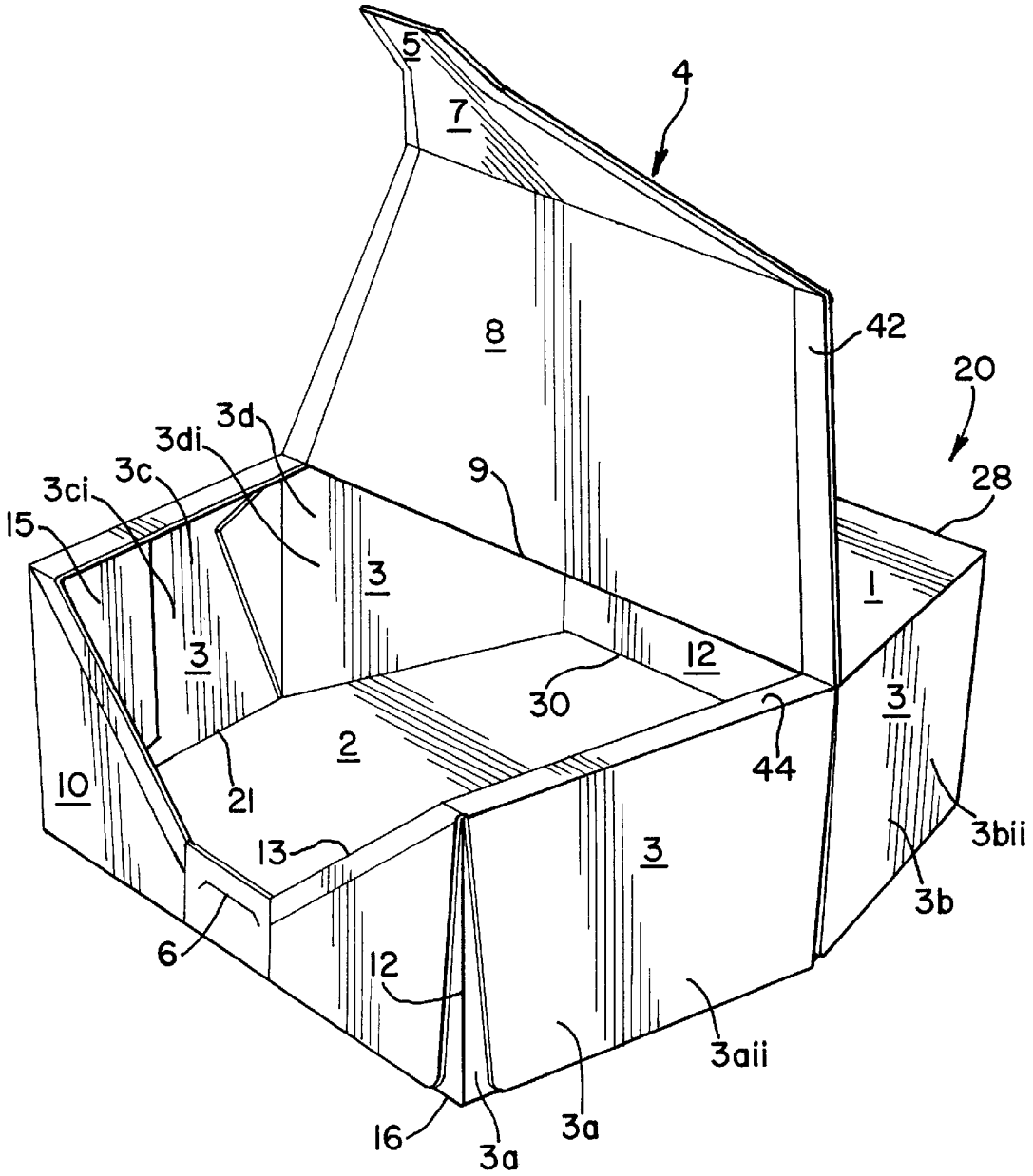
FIG. 1 is a top perspective view of the present package in the assembled format and having a six edged configuration.

Referring now to FIG. 1, a package generally designated 20 includes a front wall 1, a back wall 2 and preferably four side walls 3. Included in the side walls 3 are a first side wall 3*a*, a second side wall 3*b*, a third side wall 3*c*, and a fourth side wall 3*d*. A notched opening in a notched wall 10, connected to the back wall 2, is defined by a notched wall edge 13. A first notched wall flap 11, and a second notched wall flap 15 (see FIG. 2) are located on either side of the wall 10. The back wall 2 is connected to the front wall 1 via the side walls 3 and a rear wall 12. The front wall 1 is connected to a lid, generally designated 4, at a marking line or hinge line 9.

In the preferred embodiment, the marking line 9 is perforated or scored for easy pivoting, and the line extends across the full width of the front wall 1 at the widest part of the front wall. Other lengths for the line 9 are contemplated depending on the application.

Included on the lid 4 is a front wall lid portion 8, a tapered portion 7 configured for closing the notched opening defined by the notched wall edge 13, and a tab 5. The tab 5 is configured to be releasably engaged in a slit 6 located in the notched wall 10. In the preferred embodiment, the length of the lid 4 between the tapered portion 7 and the marking line 9 line is at least half as long as the front wall 1.

Figure 2:
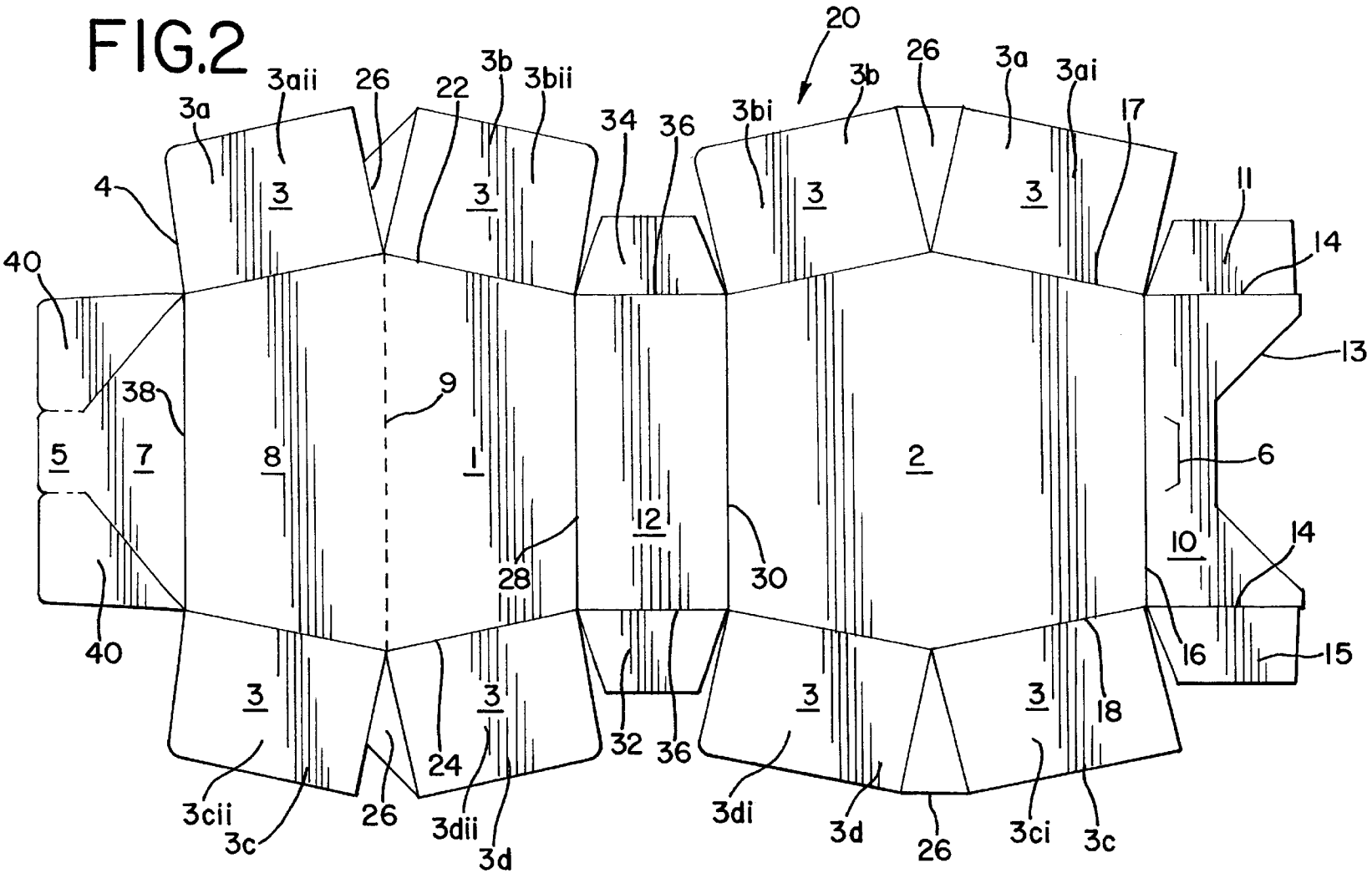
FIG. 2 is an overhead view of a sheet cut for the package depicted in FIG. 1, prior to assembly.

Referring now to FIG. 2, a sheet cut for the manufacture of the package 20 is depicted. The back wall 2 is connected to the notched wall 10 at a wall fold 16. In addition, the first and second notched wall flaps 11 and 15, respectively, are connected to the notched wall 10 by a pair of wall flap folds 14.

The back wall 2 is connected to a first inside flap 3*ai* and a second inside flap 3*bi* at a first side wall flap fold 17. Also connected to the back wall 2 is a third inside flap 3*ci* and a fourth inside flap 3*di* at a second side wall flap fold 18.

The front wall 1 is connected to first and second wall outside flaps 3*aii* and 3*bii* at a third side wall flap fold 22. The front wall 1 is also connected to third and fourth outside flaps 3*cii* and 3*dii* at a fourth flap fold 24. Adjacent side wall flaps 3*a* and 3*b*; and 3*c* and 3*d* are connected by gussets 26.

The front wall 1 is connected to the bottom wall 12 at a bottom wall first fold 28. The bottom wall 12 is connected to the back wall 2 at a bottom wall second fold 30. On the bottom wall 12 are a first bottom wall flap 32 and a second bottom wall flap 34, each of which being connected to the bottom wall at folds 36. The tapered portion 7 of the lid 4 is connected to the front wall portion 8 of the lid 4 at a tapered fold 38.

To transform the package 20 from its sheet form depicted in FIG. 2 to its constructed form as depicted in FIG. 1, the inside flaps 3*ai*, 3*bi*, 3*ci* and 3*di* are folded along the first side wall flap folds 17,18 such that they are positioned to project vertically and generally normally to the back wall 2. It will be understood that the front and back walls 1, 2 are depicted as being disposed flat upon a substrate, such as a work table, and the flaps 3*ai*3*di* are folded upwardly therefrom. Similarly, turning to the front wall 1 and the front wall lid portion 8, the flaps 3*aii*, 3*bii*, 3*cii* and 3*dii* are folded along the corresponding flap folds 22, 24 such that they are positioned to project vertically and generally normally to the front wall.

Next, the first notched wall flap 11 and the second notched wall flap 15 are folded along the flap folds 14, and the notched wall 10 is folded along the notched wall fold 16 such that the notched wall 10 is maintained at a normal or perpendicular angle to the back wall 2. Stability can be increased by fastening, such as by gluing, the first notched wall flap 11 to the first inside flap 3*ai* and gluing the second notched wall flap 15 to the third inside flap 3*ci*. Paper, cardboard, plastic or other rigid materials can be used when constructing the package 20. The package 20 can easily and efficiently be made out of one piece.

Next, the front wall 1 is folded along the bottom wall first fold 28 and the back wall 2 is folded along the bottom wall second fold 30, causing the front wall 1 and the back wall 2 to face each other in spaced, parallel relationship. Stability may also be increased by fastening, such as by gluing, the inside flaps 3*ai*, 3*bi*, 3*ci* and 3*di* to their respective outside flaps, 3*aii*, 3*bii*, 3*cii* and 3*dii* as is known in the art. The flaps 32, 34 are then preferably fastened, as by gluing or known equivalent fastening technology, to the inside of the flaps 3*bi*, 3*bii* and 3*di*, 3*dii*.

Lastly, the package 20 is filled and closed by sealing the tapered portion 7 to the corresponding edges 13 of the notched wall 10 by adhesive, glue or perforated score line as is known in the art. By sealing the unopened package in this manner, the contents are better preserved, and an indication of tampering is also provided. In FIG. 1, opposing edge lips 42, 44 are where such pre-opening fastening may occur. In addition, triangular flaps 40 may also be sealingly secured to opposing surfaces of the notched wall 10 until the package is initially opened. Once the seals about the tapered portion 7 and the lid 8 are broken and the package opened, the package 20 can be reclosed by inserting the tab 5 into the slot 6.

While a particular embodiment of the three dimensional package with an opening that can be closed has been shown and described, it will be appreciated by those skilled in the art that changes and modifications may be made thereto without departing from the invention in its broader aspects and as set forth in the following claims.

What is claimed is:

1. A three dimensional package comprising:

a front wall and a back wall;

a plurality of side walls joining said front wall to said back wall in spaced, generally parallel relationship, said side walls including a first side wall, a second side wall, a third side wall, and a notched side wall defining a notched opening; and a lid having a front wall lid portion, a tapered portion configured for covering said notched opening, and a tab configured for being gripped by a user, said lid being hinged to the front wall along a hinge line;

wherein when said package is in a closed position, said tab engages in a slit in said notched side wall.

2. The package according to claim 1, characterized in that said front and said back wall each have six edges.

3. The package according to claim 1, characterized in that said hinge line on said front wall extends across the full width of said front wall at a widest part of said front wall.

4. The package according to claim 2, characterized in that said hinge line on said front wall extends across the full width of said front wall at the widest part of said front wall.

5. The package according to claim 1, characterized in that the length of the lid portion between said tapered portion and said hinge line is at least half as long as said front wall.

6. The package according to claim 2, characterized in that the length of the lid portion between said tapered portion and said hinge line is at least half as long as said front wall.

7. The package according to claim 3, characterized in that the length of said lid portion between said tapered portion and said hinge line is at least half as long as said front wall.

8. The package according to claim 1, characterized in that said unopened lid is glued or perforated along its edges.

9. The package according to claim 2, characterized in that said unopened lid is glued or perforated along its edges.

10. The package according to claim 3, characterized in that said unopened lid is glued or perforated along its edges.

11. The package according to claim 5, characterized in that said unopened lid is glued or perforated along its edges.

12. The package according to claim 1, characterized in that said package is made of paper, cardboard and/or plastic.

13. The package according to claim 2, characterized in that said package is made of paper, cardboard and/or plastic.

14. The package according to claim 3, characterized in that said package is made of paper, cardboard and/or plastic.

15. The package according to claim 5, characterized in that said package is made of paper, cardboard and/or plastic.

16. The package according to claim 8, characterized in that said package is made of paper, cardboard and/or plastic.

* * * * *